United States Patent [19]

Kandakov et al.

[11] 4,143,704

[45] Mar. 13, 1979

[54] REGENERATIVE HEATER

[76] Inventors: Gennady P. Kandakov, Sevastopolsky prospekt, 51, korpus 2, kv. 163; Viktor Y. Miller, Perekopskaya ulitsa, 11, korpus 4, kv. 41; Lev A. Sorokin, ulitsa Udaltsova, 4, kv. 124; Alexandr E. Sukhorukov, ulitsa Akademika Koroleva, 3a, kv. 29, all of Moscow, U.S.S.R.

[21] Appl. No.: 844,897

[22] Filed: Oct. 25, 1977

[51] Int. Cl.[2] ..... F28D 17/00

[52] U.S. Cl. ..... 165/9.2; 165/9.4

[58] Field of Search ..... 165/9.2, 9.4, 9.1

[56] References Cited

U.S. PATENT DOCUMENTS

| | | | |
|---|---|---|---|
| 2,198,054 | 4/1940 | Linder | 165/9.2 |
| 2,493,458 | 1/1950 | Koenig | 165/9.4 |
| 3,326,541 | 6/1967 | Davies et al. | 165/9.2 |

*Primary Examiner*—Albert W. Davis, Jr.

*Attorney, Agent, or Firm*—Lackenbach, Lilling & Siegel

[57] ABSTRACT

The regenerative heater comprises the brickwork of the walls and checker of refractory materials with different coefficients of linear expansion enclosed within a jacket also included are superimposed horizontal sections corresponding to the distribution of the internal operating temperatures. Each of the horizontal sections consists of a homogeneous refractory material. Arranged between the horizontal sections are transition sections, each consisting of the refractory materials of the contiguous sections, the materials being uniformly distributed in each course and superimposed so that the content of the material in one of the contiguous section gradually diminishes from course to course toward the other section.

3 Claims, 5 Drawing Figures

REGENERATIVE HEATER

FIELD OF THE INVENTION

The present invention relates to heaters and, in particular, to regenerative heaters.

The present invention can also be utilized in heat exchangers in which gases are conducted through the open brickwork of regenerative chambers. This permits the brickwork to heat. Then, another gas is passed through the brickwork to raise the gas temperature due to its contact with the heated bricks.

The present invention is of particular advantage in ironmaking for heating the blast. Therefore it will be described in terms of this specific embodiment. However, it is not intended that the invention be limited to the disclosed embodiment.

DESCRIPTION OF THE PRIOR ART

The heaters in the category of high-temperature hot air stoves for blast furnaces are well known in ironmaking. These heaters comprise, a wall and checker brickwork of refractory materials having different coefficients of linear expansion. The wall and checker brickwork are encased within a jacket. Also included are superimposed horizontal sections corresponding to the distribution of internal operating temperatures of the regenerative heater, each of the sections consisting of a homogeneous refractory material.

The checkers of commonly used regenerative heaters are made of bricks in such a way that vertical channels are formed throughout the entire height of the checkers.

The cycle of blast heating in the regenerative heaters consists of two stages. During the first stage a mixture of gas with air is burnt and the hot combustion products are conducted through the checkers chamber, thereby heating the brickwork to a high temperature. During the second stage, in order to heat the air the required temperature, it is passed through the heated checker brickwork.

In conventional regenerative heaters the temperature under the dome reaches 1600° C. and the temperature gradient in hot blast heating is of the order of 150° C. in the upper zones and of the order of 300° C. in the lower zones. In accordance with the distribution of the internal operating temperature by zones, the brickwork of the walls and checker in conventional heaters is made of various refractories, such as dinas brick, high-alumina and fireclay materials. Thus, in the high-temperature zone the brickwork is made of hard-burnt high-strength dinas brick, whereas in the lower zones, relatively low temperature kaolin, high-alumina and fireclay refractories are used. Thus, in each temperature zone characterized by a certain temperature range, the horizontal section is made from the refractory best suitable by its strength characteristics for the operating conditions of the given zone.

In heating, the contiguous areas of the horizontal sections develop relative radial shifts of the brickwork due to the difference in the coefficients of linear expansion of the refractories. For example, for dinas brick the coefficient of linear expansion is on the average $12 \cdot 10^{-6}$1/deg, and for kaolin refractories it is $6 \cdot 10^{-6}$1-/deg. When heating to 1000° C. brickwork of a radius of 500 cm there is a relative shift of the contiguous horizontal section $\Delta R = \alpha_1 TR - \alpha_2 TR$, in which $\alpha_1$ = coefficient of linear expansion of dinas brick $\alpha_2$ = coefficient of linear expansion of kaolin refractories T = temperature in the area of conjugation of horizontal sections R = average brickwork radius, which is about 20–30 mm.

As a result of such shift the peripheral flues of a 40 mm diameter in the checker brickwork in the plane of conjugation of the horizontal sections will be overlapped up to 50–75%, and on the average in the brickwork section by 30–40%, which will cause a respective loss of efficiency of the regenerative heater, and hence, of the blast furnace.

The relative shift of the brickwork in the areas of conjugation of the horizontal sections increases in direct proportion to the increase in the brickwork diameter and heating temperature.

The contemporary stage of blast furnace construction is characterized by a substantial increase in the volume of blast furnaces (up to 5000 $m^3$) and hot blast temperature above 1400° C. The dimensions of heaters increase to 14 m in diameter and 50 m in height, while dome heating increases to 1600° C. All this entails the need to employ new materials possessing higher refractories, whose coefficient of linear expansion significantly differs from that of commonly used refractory materials. Thus, the danger of reduction in the efficiency of modern large heaters for the above reasons considerably increases.

SUMMARY OF THE INVENTION

The principal object of the present invention is to provide a regenerative heater with an arrangement of the brickwork of the walls and checkers that would substantially reduce radial shifts between conjugated horizontal sections.

Another object of the invention is to provide a regenerative heater with a substantially constant clear opening of the vertical gas flues.

Still another object of the invention is to provide a regenerative heater with increased supporting power of the brickwork of the walls and checkers.

A further object of the invention is to provide a regenerative heater with uniform distribution of tensile and compression strains caused by alternate heating and cooling.

These and other objects are attained in a regenerative heater comprising a wall and checker brickwork of refractory materials having different coefficients of linear expansion. The wall and checker brickwork are encased within a jacket. Also included are superimposed horizontal sections corresponding to the distribution of internal operating temperatures of the regenerative heater. Each of the sections consists of a homogeneous refractory material. According to the invention, between the horizontal sections there are transition sections, each being formed by at least one course of refractory materials of contiguous horizontal sections, the material of one section being uniformly distributed within that of the other section.

Such a construction of the regnerative heater is considerably less susceptible to radial shifts in each course between the contiguous horizontal sections, due to which the clear opening of the vertical flues changes less, which, in turn, makes it possible to increase the efficiency of the heaters, and hence, the furnaces they serve. Additionally, the uniform distribution of refractories of two contiguous horizontal sections in each course of the walls and checker provides a uniform distribution of strains over the entire cross-sectional area of the transition section and for a smaller specific shift of the courses. The reduction in the shift between the horizontal sections also contributes to the strength of the brickwork of the walls and checker, since the refractory materials will be characterized by a longer service life and the strained state of the jacket of the regenerative heater will be improved in the areas of conjugation of the horizontal sections.

It is especially advantageous to lay each transition section of several courses of both contiguous horizontal sections with a gradual reduction therein of the refractory material of one horizontal section towards the other, which will contribute to smoothing the profile of the gas flues, i.e., to equalizing the clear opening of the flues throughout the entire height of each transition section.

It has been established that the optimum height of the transition section of the regenerative heater is about 0.15 to 5% of the total height of the regenerative heater.

BRIEF DESCRIPTION OF THE DRAWING

Other objects and advantages of the present invention will become evident from the following description of its one embodiment with reference to the accompanying drawings in which.

DETAILED DESCRIPTION OF THE DRAWING

Figure 1:
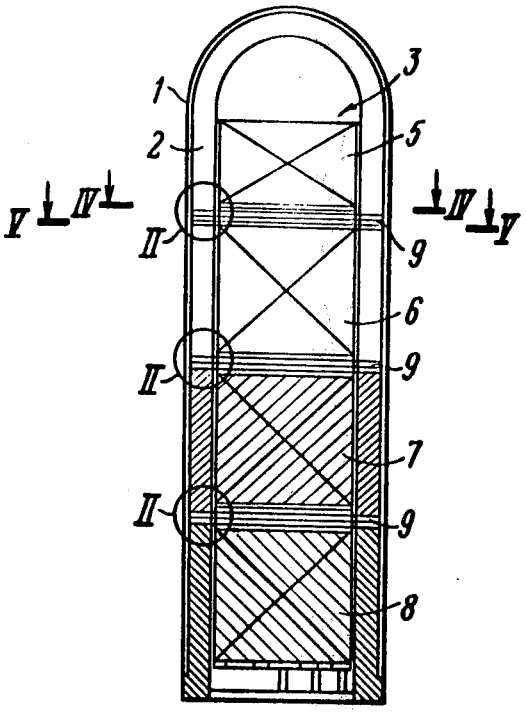
FIG. 1 is an elevational, cross-sectional view of the regenerative heater, according to the invention.

As it is evident from FIG. 1, the regenerative heater comprises a jacket 1 made as a steel cylinder with a dome at the top. It encloses the brickwork of walls 2 and checker 3 made of refractory materials with different coefficients of linear expansion and formed by superimposed horizontal sections corresponding to the distribution of the heater internal operating temperatures, each of the horizontal sections consisting of a homogeneous refractory material.

Figure 2:
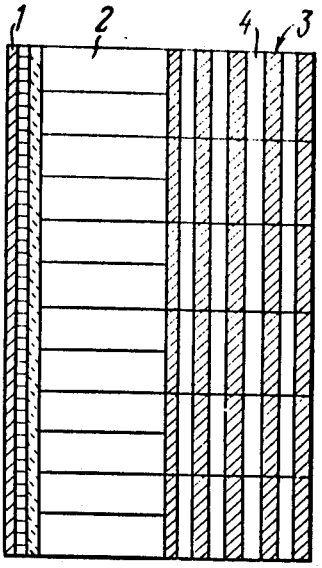
FIG. 2 is an enlarged, cross-sectional view of a portion of the brickwork of the wall and checker in a preheated state.
Figure 3:
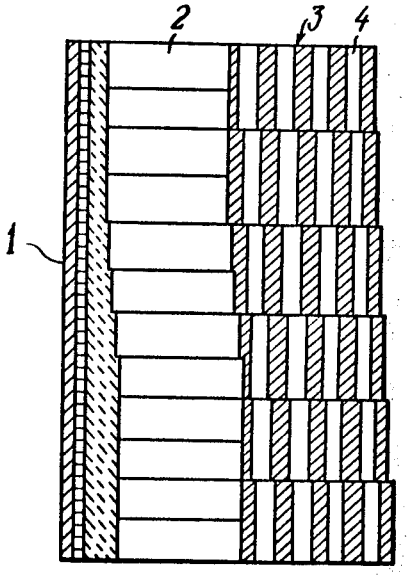
FIG. 3 is a view similar to FIG. 2, but in a heated state.

The brickwork of the walls and checker consists of a plurality of superimposed courses so that vertical flues 4, shown in FIGS. 2 and 3, are formed in the checker 3 for passage of gases.

In accordance with the distribution of the heater internal operating temperatures, several superimposed courses of homogeneous material form horizontal sections 5, 6, 7, 8. For example, the top section 5 is made of dinas brick, the next one of high-alumina refractories and the last one of fireclay.

Disposed between the contiguous sections are transition sections 9 which, according to the invention, contain at least one course from the refractory materials of the contiguous horizontal sections with a uniform distribution therein of one material among the other.

FIG. 2 shows a portion of the brickwork of the wall and checker of the regenerative heater prior to operation. Vertical flues 4 of checker 3 are rectilinear along the entire height both in the horizontal and transition sections.

Each transition section 9, according to the preferred embodiment of the invention, comprises, as shown in FIG. 2, several courses consisting of bricks of the contiguous sections.

Figure 5:
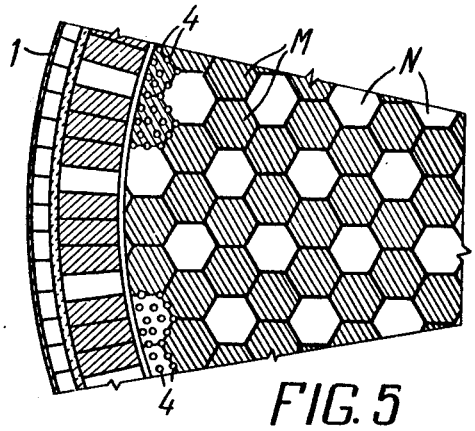
FIG. 5 is a cross-sectional view of the radial section along the line V—V of FIG. 1.
Figure 4:
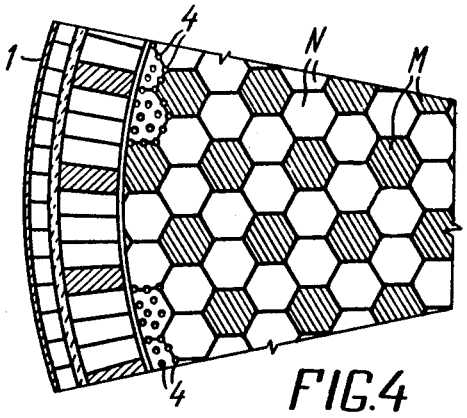
FIG. 4 is a cross-sectional view of the radial section along the line IV—IV of FIG. 1.

The bricks in each course are distributed uniformly over the entire radial sectional area of the brickwork (FIGS. 4 and 5) in such a way that the number of bricks of material M, for instance of the horizontal section 5, gradually diminishes from course to course towards the horizontal section 6, whereas the number of bricks of material N of the contiguous horizontal section 6 increases respectively. That is, the total number of bricks in each of the courses is constant, whereas the ratio of bricks made from the material of the contiguous sections varies as stated above. The above condition is valid for all the horizontal sections.

In the course of operation of the heater the brickwork of the walls 2 and the checker 3 sustains tension and compression strains resulting in a shift of each course. With K courses in the transition sections, the relative shift of each course diminishes K times with respect to the common brickwork construction. Therefore, the overlapping of the vertical flues 4 caused by the shift of the courses will be K times less. By increasing K, it is possible to bring the overlapping to an acceptible magnitude at which only some bending of the vertical flues will occur without reduction in the cross sectional area of the latter within the transition sections 9 (FIG. 3). This causes the rated efficiency of the regenerative heater will be assured.

The height of each of the transition sections 9 is selected with due account to the planned efficiency, thermal characteristics, and design features of the regenerative heaters and will amount to 0.15 to 5% of the total height of the heater, i.e., a value dependent on the brick height and the number of courses in each transition section.

Thus, due to the transition sections a gradual bending of the vertical flues occurs at the conjugating areas of the horizontal sections without diminishing the cross sectional areas of the flues which provides for the rated efficiency of the heaters, increased brickwork strength and service life. The brickwork of the walls, bending gradually, improves the strained state of the jacket in the areas of conjugation of the horizontal sections, eliminates the appearance of large cracks in the brickwork and enhances the operational reliability of the regenerative heater.

What we claim is:

1. A regenerative heater, comprising a wall and checker brickwork of refractory materials having different coefficients of linear expansion, said wall and checker brickwork being encased within a jacket and comprising superimposed horizontal sections corresponding to the distribution of internal operating temperatures of the regenerative heater and transition sections to diminish the relative displacement of the horizontal sections caused by heat expansion; each of said horizontal sections being made of a homogeneous refractory material; each of said transition sections being disposed between said horizontal sections and formed by at least one course of refractory materials of horizontal sections contiguous to said transition section, the refractory material of one section being uniformly distributed within that of the other section.

2. A regenerative heater according to claim 1, wherein the transition section is formed by several courses made of the refractory materials of the contiguous sections, the materials being uniformly distributed in each course and superimposed so that the content of the material in one of the contiguous horizontal sections gradually diminishes from course to course toward the other section.

3. A regenerative heater according to claim 1, wherein the height of the transition section ranges from 0.15 to 5% of the total height of the heater.

* * * * *